US006773665B1

(12) United States Patent
Sakai

(10) Patent No.: US 6,773,665 B1
(45) Date of Patent: Aug. 10, 2004

(54) NON-CU-BASED CAST AL ALLOY AND METHOD FOR HEAT TREATMENT THEREOF

(75) Inventor: Takayuki Sakai, Kikugawa-cho (JP)

(73) Assignee: Asahi Tec Corporation (JP)

( * ) Notice: Subject to any disclaimer, the term of this patent is extended or adjusted under 35 U.S.C. 154(b) by 144 days.

(21) Appl. No.: 10/049,421

(22) PCT Filed: Aug. 22, 2000

(86) PCT No.: PCT/JP00/05600

§ 371 (c)(1),
(2), (4) Date: Mar. 15, 2002

(87) PCT Pub. No.: WO01/16387

PCT Pub. Date: Aug. 3, 2001

(30) Foreign Application Priority Data

| | | |
|---|---|---|
| Aug. 31, 1999 | (JP) | 11/246813 |
| Mar. 1, 2000 | (JP) | 2000/56560 |
| Apr. 28, 2000 | (JP) | 2000/131414 |

(51) Int. Cl.[7] ..... C22C 21/04
(52) U.S. Cl. ..... 420/546; 420/549; 148/415
(58) Field of Search ..... 148/415; 420/546, 420/549

(56) References Cited

FOREIGN PATENT DOCUMENTS

| | | | |
|---|---|---|---|
| JP | 2-34739 | 2/1990 | |
| JP | 02034739 A * | 2/1990 | ..... C22C/21/04 |
| JP | 7-310150 | 11/1995 | |
| JP | 9-272957 | 10/1997 | |
| JP | 2000-17413 | 1/2000 | |

* cited by examiner

*Primary Examiner*—George Wyszomierski
*Assistant Examiner*—Janelle Combs Morillo
(74) *Attorney, Agent, or Firm*—Parkhurst & Wendel, L.L.P.

(57) ABSTRACT

A non-Cu-based cast Al alloy contains substantially no Cu, and has a tensile strength of 305 MPa or more, a 0.2% yield strength of 220 MPa or more, and an elongation of 10% or more. In the heat treatment of the cast Al alloy, the solution treatment is performed using a fluidized bed 18, and the solution treatment is performed by rapid heating up to the solution treatment temperature in 30 minutes, and maintaining the solution treatment temperature in 3 hours or less. Because this method for heat treatment performs solution treatment at an increased speed of heating-up time, with small deviation of temperature, and at a higher temperature, total time for heat treatment can be shortened drastically in comparison with the conventional method. A non-Cu-based cast Al alloy having well-balanced mechanical properties of tensile strength, yield strength, and elongation can be provided.

5 Claims, 7 Drawing Sheets

NON-CU-BASED CAST AL ALLOY AND METHOD FOR HEAT TREATMENT THEREOF

TECHNICAL FIELD

The present invention relates to a non-Cu-based cast Al alloy that contains substantially no Cu, and to a method for the heat treatment thereof.

BACKGROUND ART

Al—Si-based aluminum (Al) alloys that mainly consist of Al containing several percent Si by weight have been known as Al alloys for casting or die casting, and multi-phase Al—Si-based alloys that further contain other elements such as Cu and Mg in addition to the basic composition of the Al—Si-based Al alloys have been used as alloys for casting. This is because these alloys have better properties important for casting or die casting, such as the fluidity of the molten metal and mold filling, than other alloys; little casting crack occurs; alloys that have higher strength can be obtained by combining other elements; and these alloys have a small coefficient of thermal expansion and a high wear resistance.

Examples of Al—Si-based alloys to which a small quantity of Mg is added include AC4A, AC4C, and AC4CH. These alloys have increased strength by the effect of heat treatment to precipitate the intermediate phase of $Mg_2Si$. In particular, AC4C and AC4CH, which has increased toughness by limiting the Fe content to 0.20% by mass or less, is used as alloys for wheels of vehicles such as motor vehicles.

Furthermore, Al—Si-based alloys to which small quantities of Mg and Cu are added are also used. The strength of these alloys is improved by precipitation hardening by the intermediate phase of $Mg_2Si$, solid solution hardening by Cu, and precipitation hardening by the intermediate phase of $Al_2Cu$.

As described above, the improvement of strength of heat-treated Al alloys is achieved by the addition of other elements, and the aging and precipitation of resultant intermediate phases, and the heat treatment for aging and precipitation consists of the solution treatment and the aging treatment. The solution treatment is a heat treatment for obtaining the solid solution of a uniform composition at a high temperature, by adding a non-equilibrium phase crystallized during solidification to form a solid solution, and further adding a precipitated phase during cooling to form the solid solution. The aging treatment carried out following the solution treatment is a heat treatment for making the precipitated intermediate phases fine and uniform, and for causing precipitation hardening with the precipitated intermediate phases. These heat treatments improve the mechanical properties of the Al alloy.

Heretofore, although a controlled atmosphere furnace that uses the air as the heat medium, such as a tunnel furnace, has been used for the solution treatment and the aging treatment of such Al alloys, heating-up takes a long time, and the deviation of temperature is as large as about ±5° C., resulting in the difficulty of the solution treatment at a higher temperature.

Although above-described Al—Si-based alloys to which various elements such as Mg and Cu are added have been used as the Al alloys as the mechanical properties, they have a tensile strength of about 290 MPa, a 0.2% yield strength of about 200 MPa, and an elongation of about 8%. In an Al alloy used for wheels of motor vehicles, it is advantageous to improve the mechanical properties such as tensile strength, 0.2% yield strength, and elongation, to make the wheels of motor vehicles thinner, thereby reducing the entire weight of the motor vehicle, decreasing rolling resistance, and contributing to the elevation of fuel consumption and exhaust gas purification performance, as well as the improvement of driving stability.

On the other hand, although the strength of an Al alloy has been improved by adding Cu to the Al alloy, as described above, the corrosion resistance of the Al alloy lowers if more than a predetermined quantity of Cu is added.

Considering the above-described problems in conventional Al alloys, an object of the present invention is to provide a non-Cu-based cast Al alloy that has well-balanced mechanical properties of tensile strength, yield strength, and elongation.

Another object of the present invention is to provide a method for the heat treatment of a non-Cu-based cast Al alloy that can perform the solution treatment at an increased speed of heating-up time, with small deviation of temperature, and at a higher temperature.

DISCLOSURE OF INVENTION

According to the present invention, there is provided a non-Cu-based cast Al alloy that contains substantially no Cu, wherein the tensile strength thereof is 305 MPa or more, the yield strength thereof is 220 MPa or more, and the elongation thereof is 10% or more.

Also, the Al alloy of the present invention preferably contains 6.5 to 7.5% by mass of Si, and 0.36% by mass or less Mg, and more preferably contains 20 to 70 ppm of Sr. It is also preferable that the Al alloy of the present invention is a precipitation hardened alloy. Such a non-Cu-based cast Al alloy can be suited to wheels of vehicles such as motor vehicles.

Also, according to the present invention, there is provided a method for heat treatment of a cast Al alloy comprising; subjecting a work piece of the cast Al alloy to solution treatment, and then subjecting the work piece to aging treatment, to improve mechanical properties of the work piece, wherein at least said solution treatment is performed by rapidly raising the temperature to the solution treatment temperature within 30 minutes, and maintaining said solution treatment temperature within 3 hours to form the non-Cu-based cast Al alloy that has a tensile strength of 305 MPa or more, a 0.2% yield strength of 220 MPa or more, and an elongation of 10% or more.

Furthermore, according to the present invention, there is provided a method for heat treatment of a cast Al alloy comprising; subjecting a work piece of the cast Al alloy to solution treatment, and then subjecting the work piece to aging treatment, to improve mechanical properties of the work piece, wherein at least said solution treatment is performed by allowing said work piece to be present in a fluidized bed to form the non-Cu-based cast Al alloy that has a tensile strength of 305 MPa or more, a 0.2% yield strength of 220 MPa or more, and an elongation of 10% or more.

In the heat treatment method of the present invention, the above-described aging treatment is preferably performed by allowing the work piece to be present in a fluidized bed. Also, the fluidized bed is preferably formed by the direct blowing of hot air.

BEST MODE FOR CARRYING OUT THE INVENTION

Figure 1:
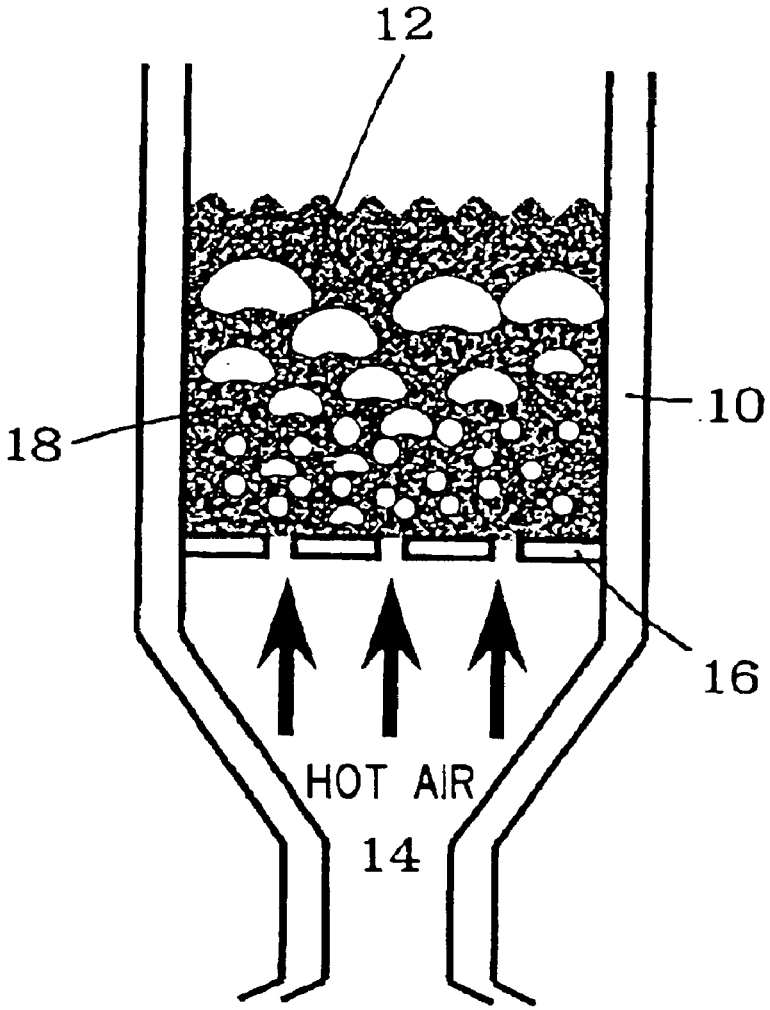
FIG. 1 is a schematic diagram showing an example of hot air direct blowing fluidized beds used in the present invention.

The present invention will be described below in detail.

A cast Al alloy of the present invention is a non-Cu-based cast Al alloy that contains substantially no Cu, and has mechanical properties, such as tensile strength, 0.2% yield strength, and elongation, of predetermined values or more, specifically, a tensile strength of 305 MPa or more, a 0.2% yield strength of 220 MPa or more, and an elongation of 10% or more.

Here, "contains substantially no Cu," means that the content of Cu in the Al alloy is 0.1% by mass or less. When the content of Cu in the Al alloy is 0.1% by mass or less, the Cu has no effect of improving strength, and does not lower the corrosion resistance of the Al alloy. The present invention relates to such a non-Cu-based cast Al alloy.

The non-Cu-based cast Al alloy according to the present invention has a tensile strength of 295 MPa or more, preferably 305 MPa or more, most preferably 320 MPa or more; a 0.2% yield strength of 220 MPa or more, preferably 240 MPa or more, most preferably 260 MPa or more; and an elongation of 10% or more, preferably 12% or more, most preferably 14% or more.

Here, the mechanical properties, such as the tensile strength, 0.2% yield strength, and elongation, of the Al alloy were measured in accordance with the test methods specified in JIS (Japanese Industrial Standards) Z2201.

The non-Cu-based cast Al alloy of the present invention that has the specified or better mechanical properties has the Al based composition that preferably contains 6.5 to 7.5% Si by mass and 0.36% by mass or less Mg, and more preferably 20 to 70 ppm of Sr. That is, the Si content within a range between 6.5 and 7.5% by mass is preferable because the casting properties of the Al alloy are improved in this range, and a range between 6.8 and 7.2% by mass is further preferable.

The casting properties of the Al alloy are worse when the Si content beyond the range between 6.5 and 7.5% by mass.

It is preferable that the content of Mg is 0.36% by mass or less. On the heat treatment, Mg precipitates an intermediate phase known as the $Mg_2Si$ phase together with Si, thereby causing significant aging hardening to occur. However, although the content of Mg exceeding 0.36% by mass increases tensile strength or the like, the problem of decrease in elongation arises.

Also, Sr acts as an agent for reducing the size of eutectic structures of the Al alloy, and the content of Sr is preferably 20 to 70 ppm, more preferably in a range between 30 and 60 ppm.

It is preferable that the non-Cu-based cast Al alloy of the present invention is a precipitation-hardened alloy in which an intermediate phase such as $Mg_2Si$ phase is precipitated by heat treatment as described above. Also, since the non-Cu-based cast Al alloy of the present invention has predetermined or better mechanical properties, such as tensile strength, 0.2% yield strength, and elongation, and these three properties are well balanced, it can be used very effectively for the wheels of vehicles such as motor vehicles.

JIS specifies that AC4C Al alloy contains 0.25% by mass or less Cu and 0.55% by mass or less Fe; and AC4CH Al alloy contains 0.2% by mass or less Cu and 0.2% by mass or less Fe. These Al alloys are effective as long as the above-described compositions of the present invention are satisfied.

Next, the non-Cu-based cast Al alloy of the present invention that has the above-described mechanical properties and compositions can be manufactures by the method for the heat treatment described below.

First, after a casting of the Al alloy (work piece) made using an ordinary method is subjected to the solution treatment, the casting is generally quenched, and then subjected to the aging treatment. By subjecting the casting to these treatments, the mechanical properties of the Al alloy can be improved so as to apply to desired uses such as vehicle wheels.

In the solution treatment of the present invention, it is important to raise the temperature of the work piece quickly to the temperature of the solution treatment in a short period of time within 30 minutes, and maintain the work piece at this temperature for 3 hours or less. More specifically, it is preferable to heat the Al alloy to the solution treatment temperature of 530 to 550° C. in about 3 to 30 minutes, and maintain the solution treatment temperature of 530 to 550° C. for 3 hours or less, preferably 1 hour or less in order to prevent the formation of spherical and coarse eutectic structure. As a result, the strength and elongation properties of the resultant Al alloy are improved.

In the solution treatment of the present invention, as described above, it is important to heat the work piece in a short period of time. For example, in the case of vehicle wheels, it is preferable to raise the temperature to 530 to 550° C. in 3 to 10 minutes. This is especially preferable for preventing the formation of coarse eutectic structure.

In the solution treatment of the present invention, it is sufficient to heat the work piece quickly, and the method is not limited to a specific method. That is, quick heating of the work piece can be achieved by controlling the ambient temperature, and for example, high-frequency heating, low-frequency heating, or far-infrared heating can be utilized, but quick heating using a fluidized bed is more preferable.

Quick heating using a fluidized bed is performed by placing the work piece in a fluidized bed.

The fluidized bed is formed by granular substances such as powder and granules heated and evenly mixed by hot air, and has features of making the temperature in the fluidized bed substantially uniform, as well as a high thermal conductivity.

The present invention utilizes these features of the fluidized bed in the solution treatment of the work piece.

The temperature uniformity (about ±2 to 3° C.) in the fluidized bed enables the solution treatment to be carried out at a higher temperature, and the high thermal conductivity shortens time for heating to the solution treatment temperature. These features are great advantage over conventional controlled atmosphere furnace using the air as the heat medium.

After the work piece is subjected to the solution treatment, it is quenched to room temperature, and is subjected to the aging treatment. This aging treatment is not limited to a specific method, and a conventional controlled atmosphere furnace using the air as the heat medium (tunnel furnace) can be used; however, the use of a fluidized bed is preferable as in the solution treatment. This is because the time for the aging treatment can be shortened, and when a fluidized bed is used for the solution treatment, the use of the same fluidized bed is preferable from the points of view of control and operation of the whole process.

Also although indirect heating systems, such as the vessel heating system to heat the vessel of the fluidized bed from the outside as a fluidized bed system, and the radiant tube system that incorporates radiant tubes in the fluidized bed, have been known and can be used, the formation of the fluidized bed using a direct heating system by directly blowing hot air is preferable because the better temperature distribution in the fluidized bed can be achieved.

Next, conditions for the method of the heat treatments in the present invention will be described.

First, the solution treatment of the work piece is carried out by heating the work piece to 530 to 550° C. in about 5 to 30 minutes, and maintaining the temperature for several minutes to 3 hours, preferably several minutes to 1 hour. The temperature for the solution treatment is more preferably 540 to 550° C., and most preferably 545 to 550° C. The work piece is then quenched to room temperature.

Next, the work piece is subjected to the aging treatment. The aging treatment is preferably carried out by heating the work piece to 160 to 200° C. in several minutes, and maintaining the temperature for several ten minutes to several hours. The temperature for the aging treatment is more preferably 170 to 190° C.

Next, the method for the heat treatment of the present invention will be described in further detail referring to drawings.

FIG. 1 is a schematic diagram showing an example of direct blowing hot air fluidized beds used in the present invention. In a vessel 10, granular substances such as powder and granules 12 are packed on a perforated plate 16, and these granules 12 are fluidized and evenly mixed by hot air 14 blown from the bottom of a perforated plate 16 to form a fluidized bed 18.

Figure 2:
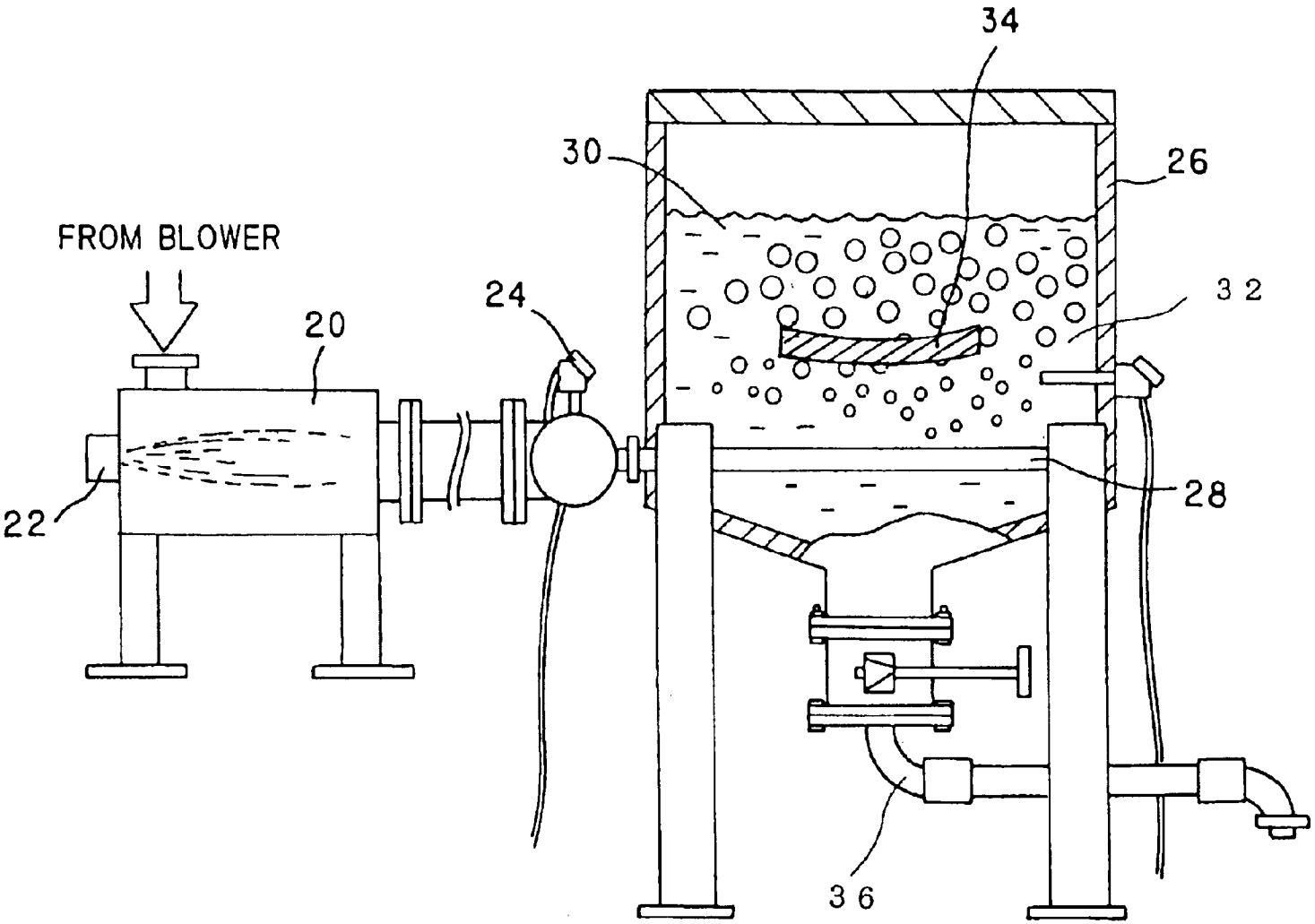
FIG. 2 is a schematic diagram showing an example of fluidized bed type solution treatment furnace used in the present invention.
Figure 3:
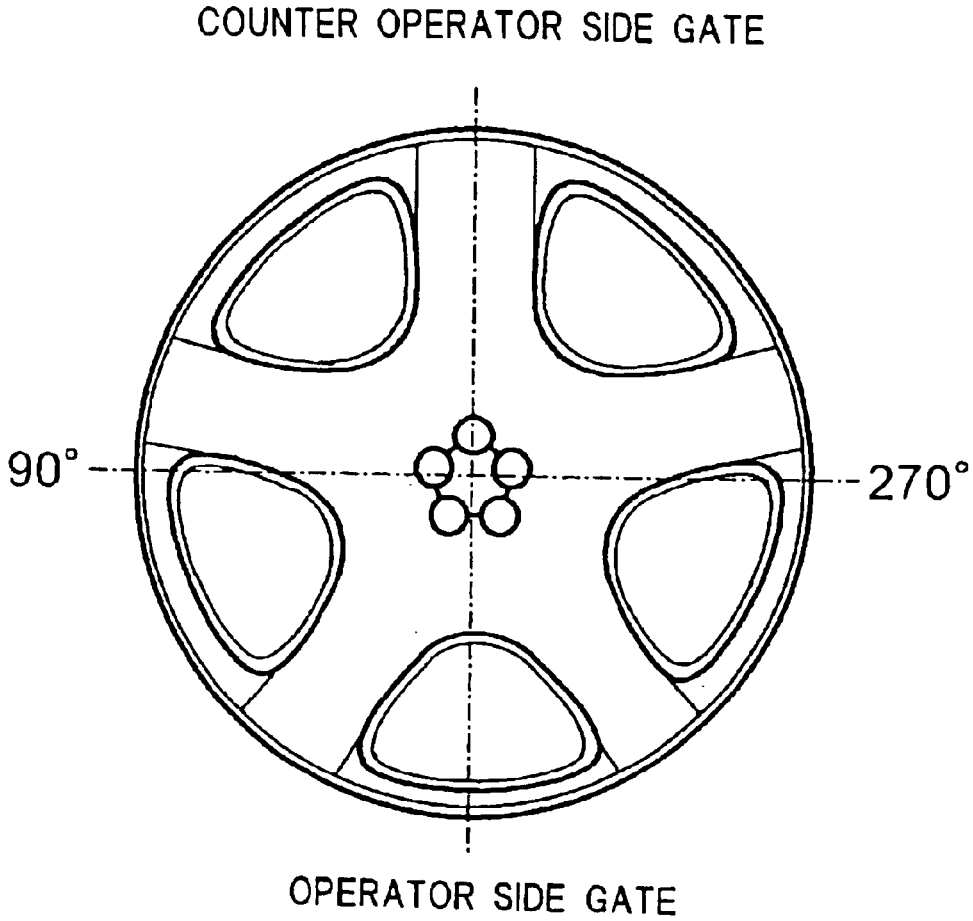
FIG. 3 is a plan showing an example of aluminum wheels for vehicles.

FIG. 2 is a schematic diagram showing an example of fluidized bed type solution treatment furnace used in the present invention. In FIG. 2, the numeral 20 represents a hot air generator, in which the air sent by a blower (not shown) is heated by flames from a burner 22 to form hot air of a temperature of 700 to 800° C. This hot air is blown to a fluidized bed type solution treatment furnace 26 through a hot air temperature monitor 24. In the fluidized bed type solution treatment furnace 26, the hot air is blown from a perforated pipe 28 into the fluidized bed 30 to fluidize and heat the granules 32. Thus, the fluidized bed 30 is heated to 530 to 550° C., and the uniformity of temperature in the furnace, in which the deviation of the furnace temperature is about 6° C. (±3° C.), and the deviation at a point is about 3° C., can be achieved. The work piece 34 present in the fluidized bed 30 is rapidly heated. A granules discharging valve 36 is used for adequately discharging the granules 32.

Although it is not shown, the fluidized bed as shown in FIGS. 1 and 2 can be used in the aging treatment of the present invention.

The present invention will now be described referring to examples.

EXAMPLE

The heat treatments of the present invention were carried out using a fluidized bed type solution treatment furnace shown in FIG. 2, and a fluidized bed type heat treatment furnace of a like constitution as an aging treatment furnace.

The fluidized bed type solution treatment furnace is constituted of a cylindrical fluidized bed vessel of an inner diameter of 1500 mm, with a straight part of a height of 750 mm, and an inverse conical bottom part. The aging treatment furnace has also the same constitution as the solution treatment furnace. As the granules, sand of an average particle diameter of 50to 500 $\mu$m was used.

A cast aluminum vehicle wheel (20 kg) was heat-treated, and test pieces were cut from the outer rim flange and the spoke. The above-described aluminum wheel contained 7.0% Si by mass, 0.34% Mg by mass, 50 ppm of Sr, the balance being Al.

Figure 4:
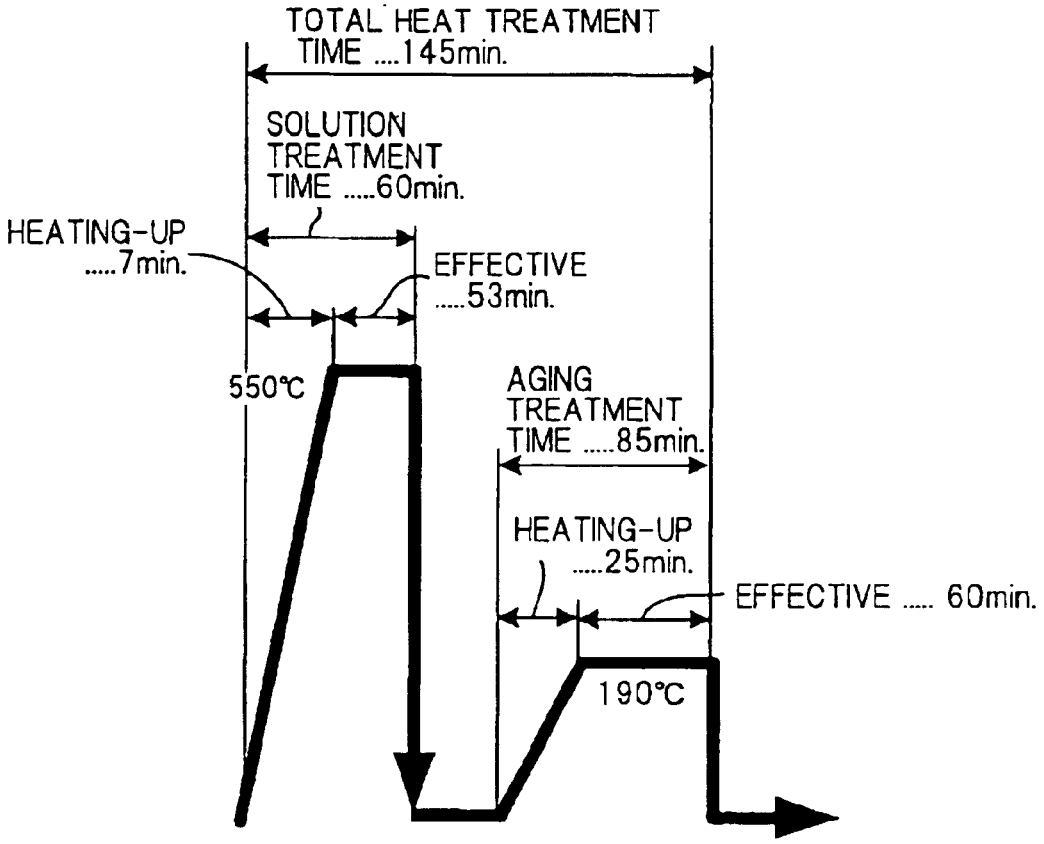
FIG. 4 is a graph showing the heat treatment schedule in the Example.

As heat treatment conditions, the solution treatment temperature was 550° C., the aging treatment temperature was 190° C. the heating-up time to the solution treatment temperature was 7 minutes, and the time to maintain the solution treatment temperature was 53 minutes, and the heat treatments were carried out in the schedule shown in FIG. 4.

Figure 5:
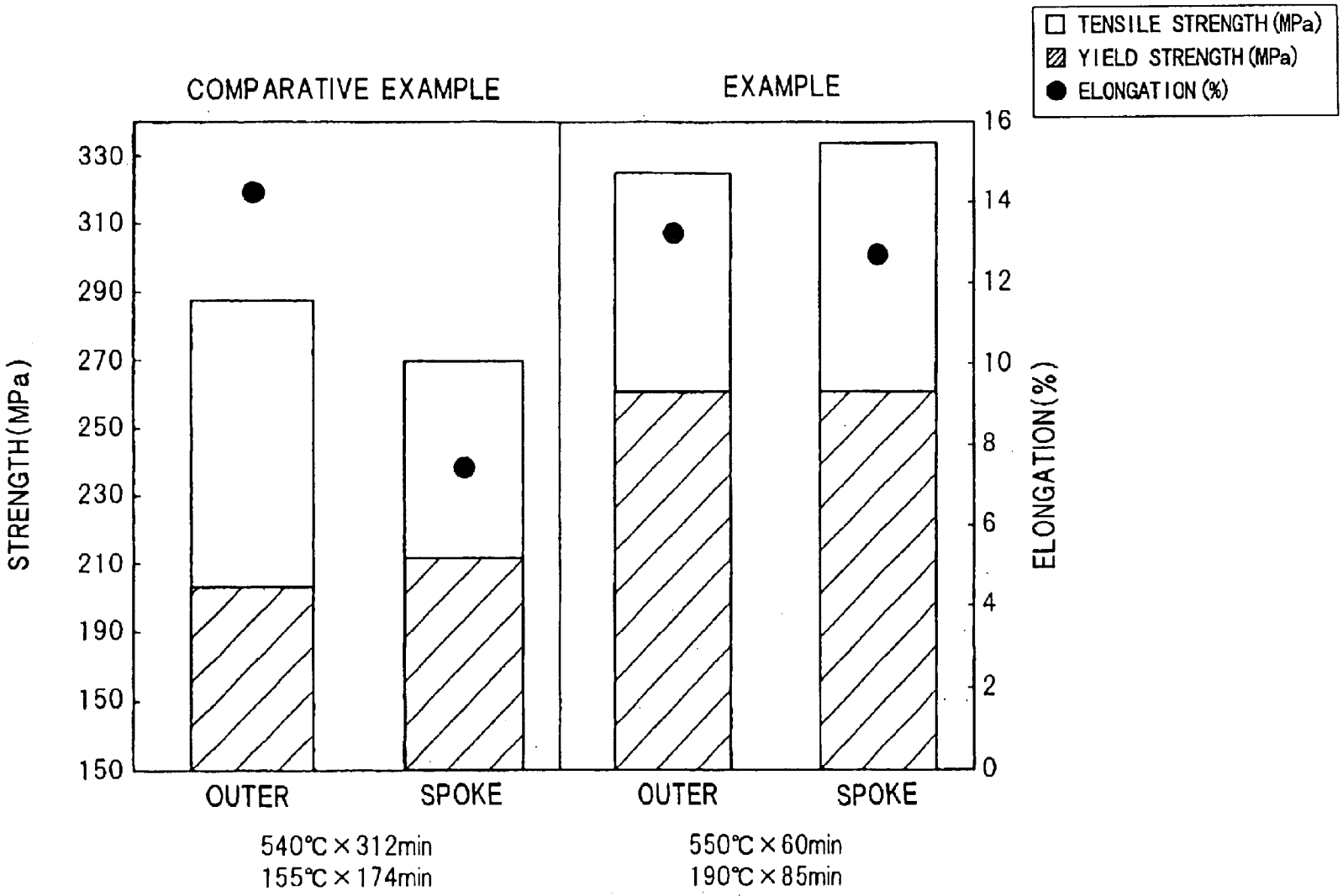
FIG. 5 is a graph showing the results of tensile tests for Example and Comparative Example.
Figure 6:
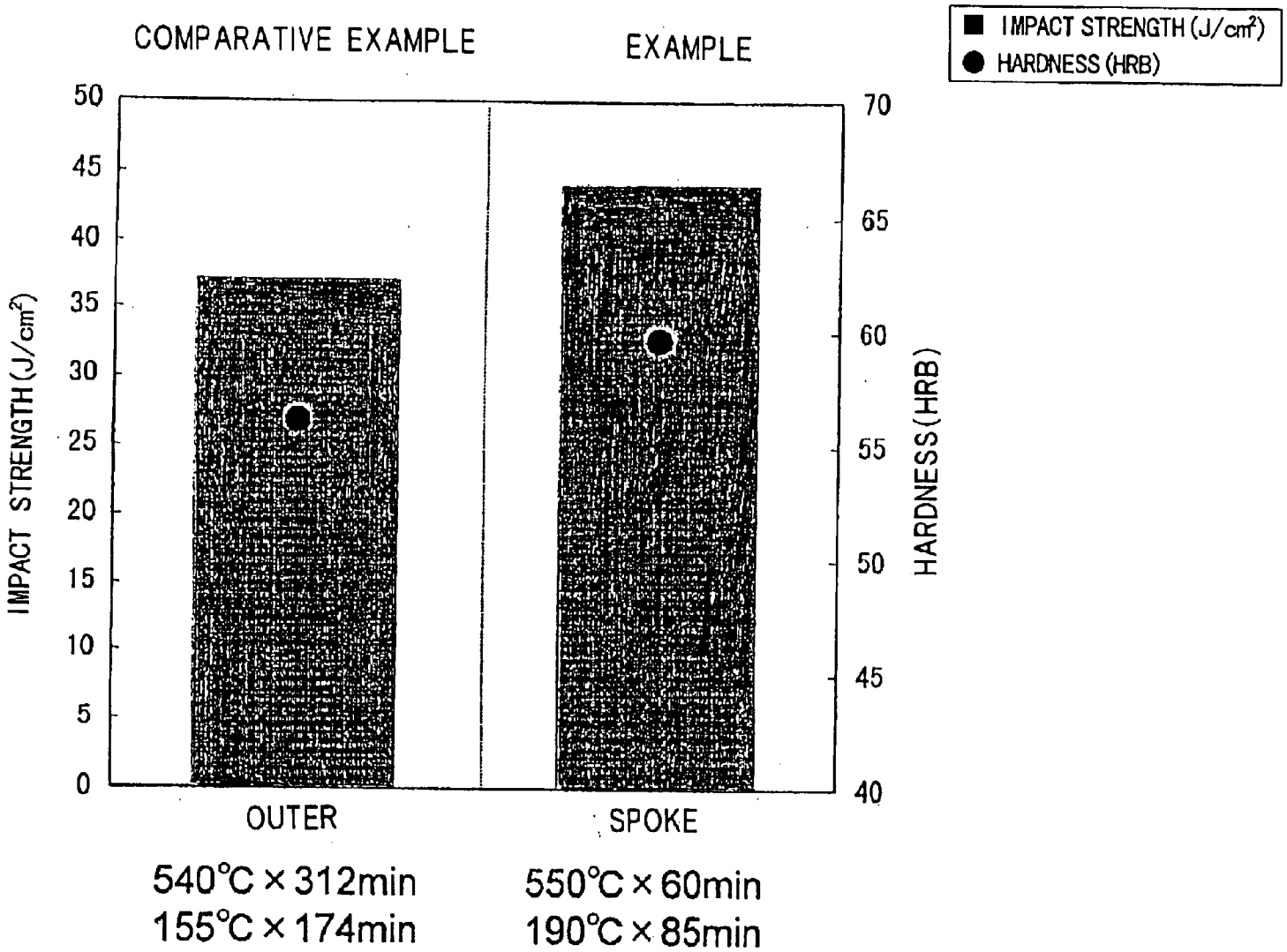
FIG. 6 is a graph showing the results of impact and hardness tests for Example and Comparative Example.

Test pieces (n=4) were cut from the heat-treated aluminum vehicle wheel, and were subjected to the tensile test (tensile strength. 0.2% yield strength, and elongation), the impact test, and the hardness test. The results are shown in FIGS. 5 and 6.

COMPARATIVE EXAMPLE

Figure 7:
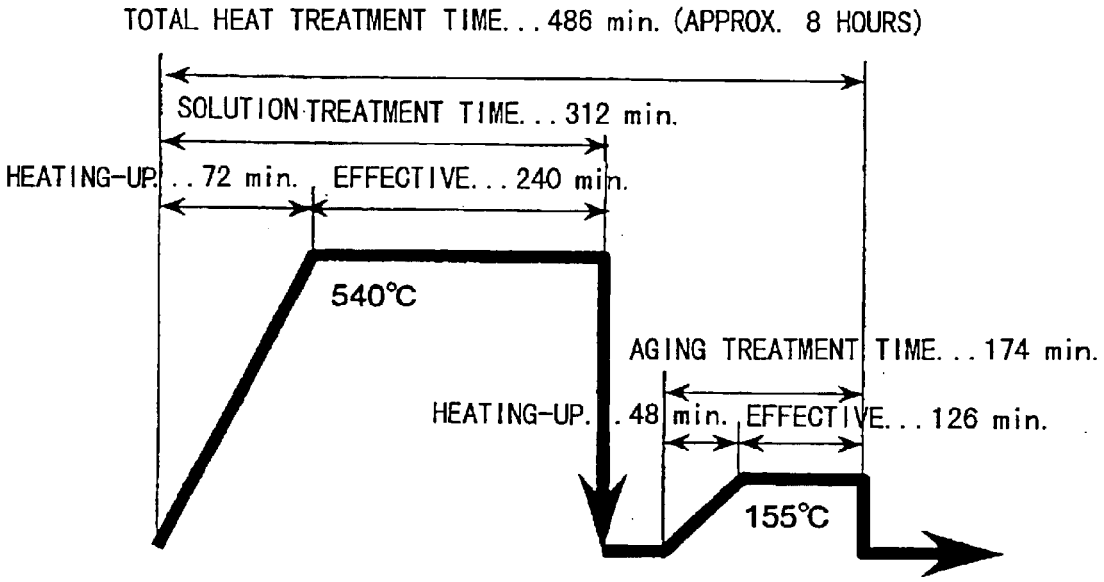
FIG. 7 is a graph showing the heat treatment schedule in the Comparative Example.

A cast aluminum vehicle wheel was heat-treated using a conventional tunnel furnace (controlled atmosphere furnace) for solution treatment and aging treatment, under the conditions of a solution treatment temperature of 540° C., an aging treatment temperature of 155° C., a heating-up time to the solution treatment temperature of 1 hour 12 minutes, and a time to maintain the solution treatment temperature was 4 hours, and the heat treatments were carried out in the schedule shown in FIG. 7. Other conditions were the same as in the Example.

Test pieces (n=4) were cut from the heat-treated aluminum vehicle wheel, and were subjected to the tensile test (tensile strength. 0.2% yield strength, and elongation), the impact test, and the hardness test. The results are shown in FIGS. 5 and 6.

As the above-described impact test, the impact strength was measured using the Charpy impact testing method specified in JIS. As the hardness test, the Rockwell hardness was measured using the testing method specified in JIS Z2245.

DISCUSSION

As the results of the tensile tests, impact tests, and hardness tests of the Example and Comparative Example obviously show, the aluminum vehicle wheel obtained from the Example has a tensile strength of 334 MPa or more, a 0.2% yield strength of 262 MPa or more, and an elongation of 12% or more. All of these values satisfied the required values of the tensile test, and in particular, the tensile strength was significantly improved compared with the tensile strength of conventional products.

What was specially noted was that by the use of a fluidized bed type furnace adopted in the Example for both solution treatment and aging treatment, the total time required for the heat treatments were shortened as as about 70% decrease compared with the use of a conventional tunnel furnace.

INDUSTRIAL APPLICABILITY

According to the heat treatment method of the present invention, as described above, the solution treatment can be performed by quick heating-up, with small deviation of temperature, and at a higher temperature, the total time for heat treatments can be shortened significantly compared with conventional methods.

Also according to the present invention, there is provided a non-cu-based cast al alloy that has well-balanced three mechanical properties of tensile strength, yield strength, and elongation.

What is claimed is:

1. A cast Al alloy that contains substantially no Cu and consists essentially of 6.5 to 7.5% Si by mass, 0.36% or less Mg by mass, and 20 to 70 ppm of Sr, wherein the tensile strength thereof is 295 MPa or more, the 0.2% yield strength thereof is 220 MPa or more, and the elongation thereof is 10% or more.

2. The cast Al alloy according to claim 1, wherein said cast Al alloy is a precipitation hardened alloy.

3. The cast Al alloy according to claim 1, wherein said cast Al alloy is used for vehicle wheels.

4. The cast Al alloy according to claim 1, wherein the tensile strength is 305 MPa or more, the 0.2% yield strength thereof is 240 MPa or more, and the elongation thereof is 12% or more.

5. The cast Al alloy according to claim 1, wherein the tensile strength is 320 MPa or more, the 0.2% yield strength thereof is 260 MPa or more, and the elongation thereof is 14% or more.

* * * * *